US012325575B2

(12) United States Patent
Yao

(10) Patent No.: US 12,325,575 B2
(45) Date of Patent: Jun. 10, 2025

(54) PORTABLE INSULATED LUNCH BOX

(71) Applicant: EVERICH COMMERCE GROUP LIMITED, Hangzhou (CN)

(72) Inventor: Huajun Yao, Hangzhou (CN)

(73) Assignee: EVERICH COMMERCE GROUP LIMITED, Hangzhou (CN)

( * ) Notice: Subject to any disclaimer, the term of this patent is extended or adjusted under 35 U.S.C. 154(b) by 71 days.

(21) Appl. No.: 18/485,295

(22) Filed: Oct. 11, 2023

(65) Prior Publication Data

US 2025/0074687 A1 Mar. 6, 2025

(30) Foreign Application Priority Data

Sep. 1, 2023 (CN) ..... 202322370920.X

(51) Int. Cl.
*B65D 81/38* (2006.01)
*B65D 43/02* (2006.01)
(Continued)

(52) U.S. Cl.
CPC ..... *B65D 81/3837* (2013.01); *B65D 43/0202* (2013.01); *B65D 43/26* (2013.01);
(Continued)

(58) Field of Classification Search
CPC ..... B65D 81/3837; B65D 43/0202; B65D 43/26; B65D 39/12; B65D 39/14; B65D 39/16; B65D 45/322; B65D 51/1672; B65D 53/02; B65D 55/02; B65D 2250/00; B65D 2251/205; B65D 2255/00; B65D 2255/02; B65D 2543/00092; B65D 2543/005; B65D 2543/00564; B65D 2543/00574;
(Continued)

(56) References Cited

U.S. PATENT DOCUMENTS 3,750,822 A * 8/1973 Dubach ..... B65D 15/14 215/361
5,392,967 A * 2/1995 Satomi ..... B65D 47/248 222/509
(Continued)

FOREIGN PATENT DOCUMENTS

CN 202944659 U * 5/2013
CN 105502249 B * 6/2018 ..... B67B 7/06
(Continued)

*Primary Examiner* — J. Gregory Pickett
*Assistant Examiner* — Brijesh V. Patel

(57) ABSTRACT

Provided is a portable insulated lunch box, including: a box body (1) and a cover body (2) adapted to the box body (1); the cover body (2) defines a mounting cavity (4) passing vertically through the cover body (2), an upper opening of the mounting cavity (4) is arranged with a pressing member (5), and multiple locking members (6), that are transversely, elastically, and movably connected, are arranged in the mounting cavity (4); an outer end of each locking member (6) passes through a cavity wall of the mounting cavity (4), and an inner end of each locking member (6) is arranged with an internal push bevel (7) matched with a lower edge of the pressing member (5); an inner side wall of the box body (1) is arranged with multiple clamping grooves (8) each matched with the outer end of a corresponding locking member (6).

10 Claims, 4 Drawing Sheets

(51) Int. Cl.

| | |
|---|---|
| ***B65D 43/26*** | (2006.01) |
| ***B65D 51/16*** | (2006.01) |
| ***B65D 53/02*** | (2006.01) |
| ***B65D 55/02*** | (2006.01) |

(52) U.S. Cl.
CPC ..... *B65D 51/1672* (2013.01); *B65D 53/02* (2013.01); *B65D 55/02* (2013.01); *B65D 2205/00* (2013.01); *B65D 2251/205* (2013.01); *B65D 2255/00* (2013.01); *B65D 2543/00092* (2013.01); *B65D 2543/005* (2013.01); *B65D 2543/00564* (2013.01); *B65D 2543/00574* (2013.01); *B65D 2543/00935* (2013.01); *B65D 2543/00972* (2013.01); *B65D 2555/02* (2013.01)

(58) Field of Classification Search
CPC ..... B65D 2543/000935; B65D 2543/00972; B67D 1/0431; F16L 33/225; F16K 1/12; F16K 31/445; B67B 7/06
USPC ..... 220/592.25, 200, 233–238, 15, 203.23, 220/203.29, 254.9, 716; 215/355–356, 215/358–361; 137/630.14–630.15
See application file for complete search history.

(56) References Cited

U.S. PATENT DOCUMENTS

| | | | | | |
|---|---|---|---|---|---|
| 5,842,612 | A * | 12/1998 | Won | B65D 47/248 | 222/509 |
| 8,807,370 | B2 * | 8/2014 | Lee | B65D 45/327 | 220/378 |
| 9,181,000 | B2 * | 11/2015 | Yoshida | B65D 41/16 | |
| 10,301,078 | B2 * | 5/2019 | Shao | B65D 39/16 | |
| 10,351,331 | B2 * | 7/2019 | Yu | B65D 81/3837 | |
| 11,427,386 | B2 * | 8/2022 | Yu | A47J 41/02 | |
| 11,772,850 | B1 * | 10/2023 | Zamora | A45F 3/18 | 215/272 |
| 12,065,287 | B1 * | 8/2024 | Hu | B65D 39/16 | |
| 2004/0040962 | A1 * | 3/2004 | Bielecki | A47J 41/0022 | 220/254.1 |
| 2005/0115977 | A1 * | 6/2005 | Dibdin | A47G 19/2272 | 222/509 |
| 2008/0272085 | A1 * | 11/2008 | Laporta | B65D 39/0064 | 215/358 |
| 2009/0159595 | A1 * | 6/2009 | Michaelian | A47G 19/2272 | 220/714 |
| 2010/0200602 | A1 * | 8/2010 | Chan | A47G 19/2272 | 220/714 |
| 2010/0237078 | A1 * | 9/2010 | Lentz | A47G 19/2288 | 220/378 |
| 2011/0186573 | A1 * | 8/2011 | Tardif | B65D 41/02 | 220/260 |
| 2017/0050775 | A1 * | 2/2017 | Sanbar | B65D 47/248 | |

FOREIGN PATENT DOCUMENTS

| | | | |
|---|---|---|---|
| CN | 214179996 | U * | 9/2021 |
| CN | 214803948 | U * | 11/2021 |
| CN | 215045212 | U * | 12/2021 |
| CN | 114524181 | A * | 5/2022 |
| CN | 217893734 | U * | 11/2022 |
| JP | 3226157 | U * | 5/2020 |

* cited by examiner

PORTABLE INSULATED LUNCH BOX

CROSS-REFERENCE TO RELATED APPLICATIONS

The present disclosure claims priority of China Patent Application No. 202322370920.X, filed on Sep. 1, 2023, the entire disclosures of which are incorporated herein by reference.

TECHNICAL FIELD

The present disclosure relates to the technical field of lunch boxes, and in particular to a portable insulated lunch box.

BACKGROUND

As a kind of container that can hold meals and keep them warm reliably, a thermal insulation lunch box is widely used. For example, CN utility model No. CN208259265U discloses a thermal insulation lunch box, specifically including an upper lunch box, a lid, articulated buckles, and snaps etc. During the closing and fixing process of the lid, it is necessary to manually trigger the multiple articulated buckles to be fixed with the snaps. The operation is cumbersome, and the portability is poor. Further, since there is no pressure relief mechanism of the lunch box, when the pressure inside the container is too high due to the heat of the meals, the lid is prone to popping in the process of opening the lid, such that the safety of use is poor.

SUMMARY OF THE DISCLOSURE

The purpose of the present disclosure is to provide a portable insulated lunch box. The present disclosure can conveniently lock and unlock the cover body, and the unlocking process can be pressure relief on the inside of the box body to enhance the safety of use.

A portable insulated lunch box, including: a box body and a cover body adapted to the box body; the cover body defines a mounting cavity passing vertically through the cover body, an upper opening of the mounting cavity is arranged with a pressing member, and a plurality of locking members, that are transversely, elastically, and movably connected, are arranged in the mounting cavity; an outer end of each locking member passes through a cavity wall of the mounting cavity, and an inner end of each locking member is arranged with an internal push bevel matched with a lower edge of the pressing member; an inner side wall of the box body is arranged with a plurality of clamping grooves each matched with the outer end of a corresponding locking member; a lower part of the mounting cavity is arranged with a pressure relief member that is vertically, elastically, and movably connected, and an exhaust gap is defined between the pressure relief member and a lower opening of the mounting cavity; a top of the pressure relief member is attached to the pressing member, and a bottom of the pressure relief member is arranged with a seal block disposed on an outside of the cover body and covering the lower opening of the mounting cavity.

In some embodiments, the pressing member includes a pressing plate, and a bottom of the pressing plate defines a functioning sleeve; a side wall of the functioning sleeve is disposed between the internal push bevel and an inner wall of the mounting cavity.

In some embodiments, the inner wall of the mounting cavity defines a limit groove, and an outer side of the functioning sleeve is arranged with a limit bump disposed in the limit groove.

In some embodiments, an inner edge of a lower end of the functioning sleeve has a rounded transition.

In some embodiments, a side part of the cover body is arranged with a plurality of sliding ports connected to the mounting cavity, and each locking member is slidably connected to a corresponding sliding port; an inner end of the locking member is arranged with a first reset spring connected to a side wall of the mounting cavity and transversally arranged.

In some embodiments, a second reset spring is arranged vertically at a bottom of the mounting cavity, and the pressure relief member includes a movable column matched with a lower opening of the mounting cavity in a spaced-apart manner, and a top of the movable column is arranged with a connection member interlocked with the movable column; the second reset spring encloses the movable post and an upper end of the second reset spring is connected to the connection member.

In some embodiments, a bottom surface of the cover body defines a circular groove matched with the lower opening of the mounting cavity, and the seal block is adapted to the circular groove; the circular groove has a beveled side.

In some embodiments, a seal ring is arranged on a lower edge of the cover body, and an annular strip is arranged on an upper part of an inner cavity of the box body matched with the seal ring.

In some embodiments, an annular foam cavity is arranged in the cover body around the mounting cavity.

In some embodiments, a lower edge of an outer end of each locking member has a rounded transition.

Compared with the related art, the present disclosure has the following beneficial effects.

1. The cover body defines a mounting cavity passing vertically through the cover body, an upper opening of the mounting cavity is arranged with a pressing member, and a plurality of locking members, that are transversely, elastically, and movably connected, are arranged in the mounting cavity; an outer end of each locking member passes through a cavity wall of the mounting cavity, and an inner end of each locking member is arranged with an internal push bevel matched with a lower edge of the pressing member; an inner side wall of the box body is arranged with a plurality of clamping grooves each matched with the outer end of a corresponding locking member; a lower part of the mounting cavity is arranged with a pressure relief member that is vertically, elastically, and movably connected, and an exhaust gap is defined between the pressure relief member and a lower opening of the mounting cavity; a top of the pressure relief member is attached to the pressing member, and a bottom of the pressure relief member is arranged with a seal block disposed on an outside of the cover body and covering the lower opening of the mounting cavity. During unlocking, the pressing member is pressed, such that the pressing member moves down and makes the locking member move inward by squeezing the internal push bevel, and the end of the locking member leaves the clamping groove of the box body, thereby realizing the unlocking such that the cover body can be pulled out quickly; after the cover body is pulled out, the hand leaves the pressing member, and the pressing member is driven reset again through the elasticity of the locking member and the internal push bevel; during the unlocking process, the pressing member further squeezes the pressure relief member to move down, and the pressure relief member moves down to drive the seal block to move away from the lower opening of the mounting cavity, such that the pressure of the box body can enter the mounting cavity from the lower opening of the mounting cavity, thereby realizing the decompression of the box body, preventing the occurrence of the cover body popping, and ensuring safe use; when the cover body is closed, the locking member of the outer end of the box body is squeezed by the edge of the box body and moved inward, and the locking member is moved outward by the elastic force and embedded in the clamping groove for quick locking when reaching the clamping groove.

2. A bottom surface of the cover body defines a circular groove matched with the lower opening of the mounting cavity, and the seal block is adapted to the circular groove. When the pressing member is not pressed down, the seal block is embedded in the circular groove, and the sealing effect of the seal block is improved by increasing the contact surface, ensuring the heat preservation effect.

Figure 1:
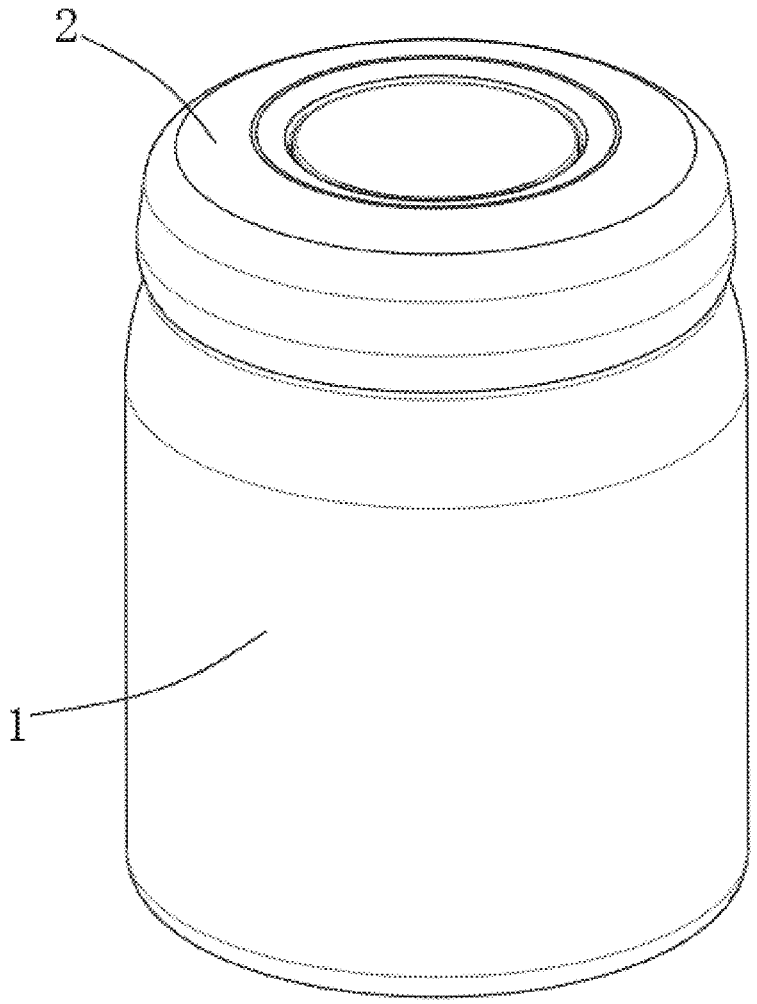
FIG. 1 is a structural schematic view of the present disclosure.

Reference numerals: 1—box body; 2—cover body; 3—seal ring; 4—mounting cavity; 5—pressing member; 6—locking member; 7—internal push bevel; 8—clamping groove; 9—pressure relief member; 10—exhaust gap; 11—seal block; 12—pressing plate; 13—functioning sleeve; 14—limit groove; 15—limit bump; 16—slip port; 17—first reset spring; 18—second reset spring; 19—movable column; 20—connection member; 21—circular groove; 22—annular foam cavity.

DETAILED DESCRIPTION

The present disclosure is further described below in conjunction with the accompanying drawings and embodiments, but is not to be taken as a basis for limiting the present disclosure.

Figure 2:
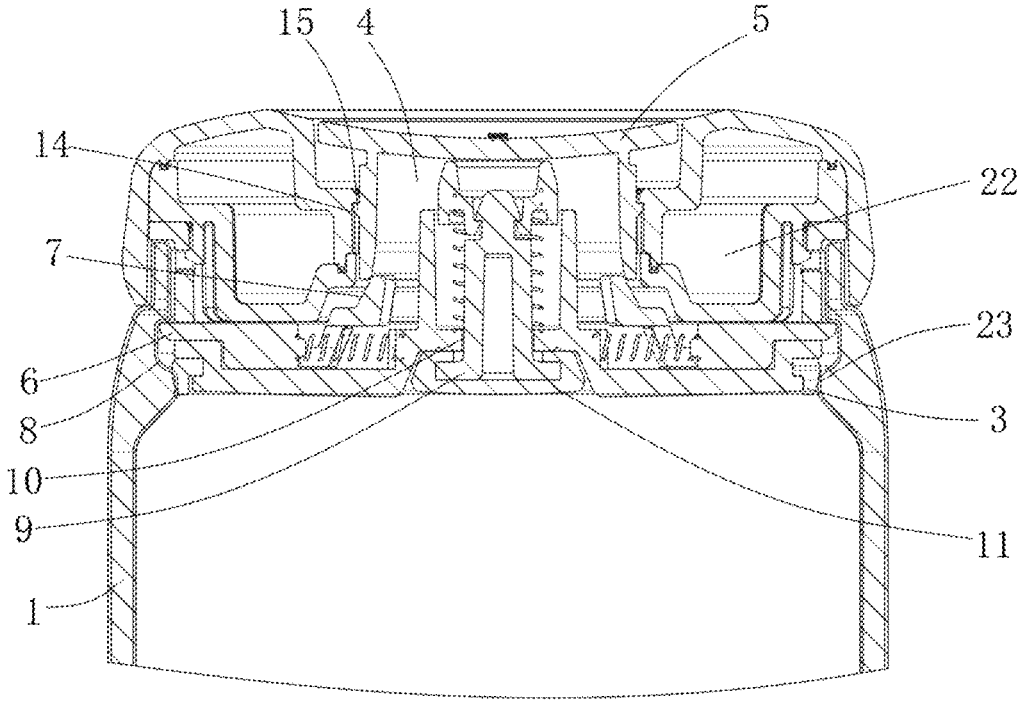
FIG. 2 is a cross-sectional structural schematic view of the present disclosure.
Figure 3:
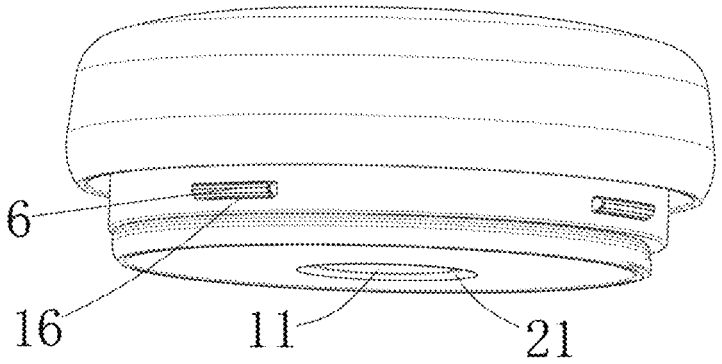
FIG. 3 is a structural schematic view of a cover body of the present disclosure.
Figure 4:
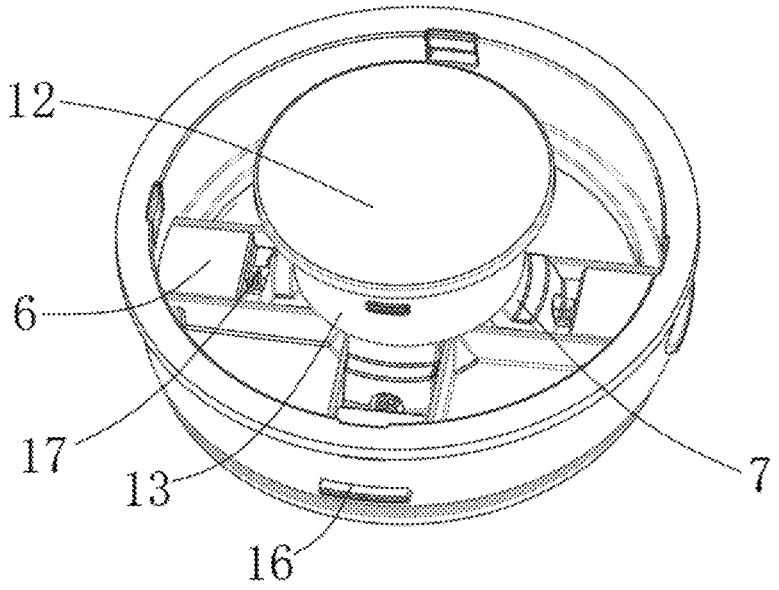
FIG. 4 is a structural schematic view of a mounting cavity of the present disclosure.
Figure 5:
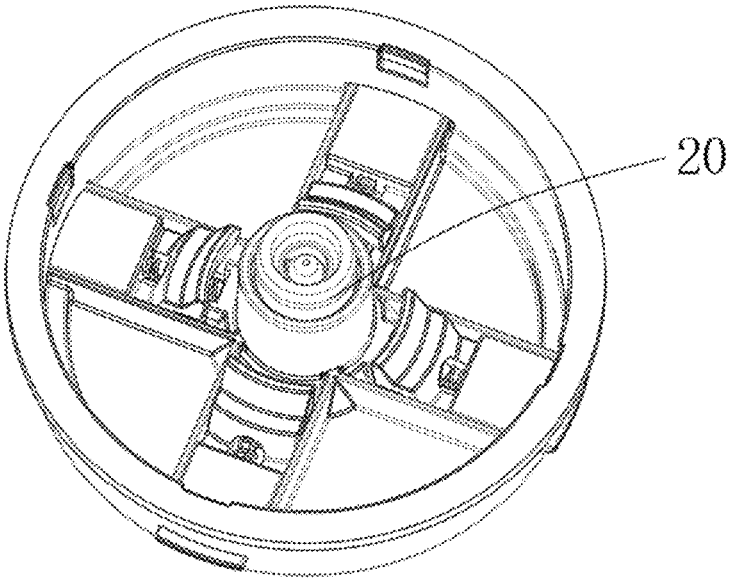
FIG. 5 is a structural schematic view of a pressure relief member of the present disclosure.
Figure 6:
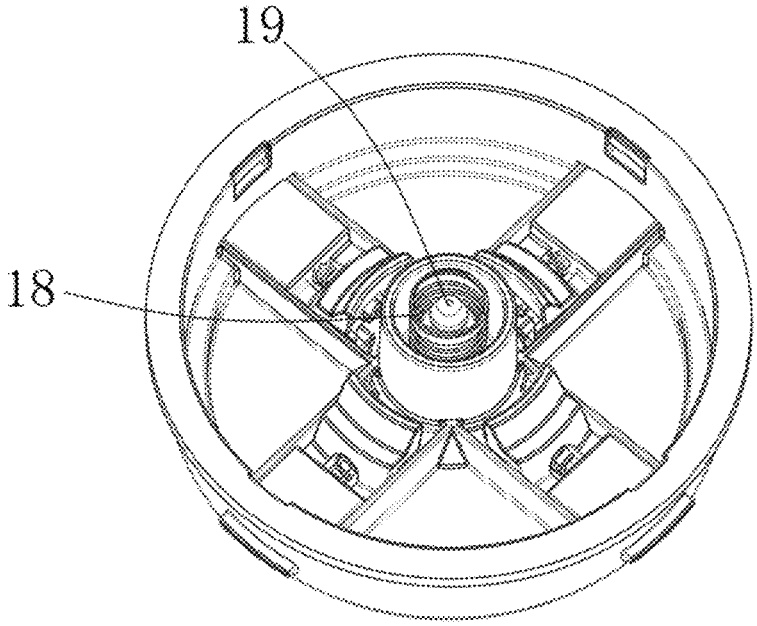
FIG. 6 is a structural schematic view of a movable column of the present disclosure.

Embodiment: a portable insulated lunch box, as shown in FIG. 1, including a box body 1 and a cover body 2 adapted to the box body 1. As shown in FIGS. 2 and 3, the cover body 2 defines a mounting cavity 4 passing vertically through the cover body 2, an upper opening of the mounting cavity 4 is arranged with a pressing member 5, and multiple locking members 6, that are transversely, elastically, and movably connected, are arranged in the mounting cavity 4; an outer end of the locking member 6 passes through a cavity wall of the mounting cavity 4, and an inner end of the locking member 6 is arranged with an internal push bevel 7 matched with a lower edge of the pressing member 5; an inner side wall of the box body 1 is arranged with a clamping groove 8 matched with the outer end of the locking member 6; a lower part of the mounting cavity 4 is arranged with a pressure relief member 9 that is vertically, elastically, and movably connected, and an exhaust gap 10 is defined between the pressure relief member 9 and a lower opening of the mounting cavity 4; a top of the pressure relief member 9 is attached to the pressing member 5, and a bottom of the pressure relief member 9 is arranged with a seal block 11 disposed on an outside of the cover body 2 and covering the lower opening of the mounting cavity 4; as shown in FIG. 4, the pressing member 5 includes a pressing plate 12, and a bottom of the pressing plate 12 defines a functioning sleeve 13; a side wall of the functioning sleeve 13 is disposed between the internal push bevel 7 and an inner wall of the mounting cavity 4, which produces a certain support effect on the functioning sleeve through the squeezing effect of the internal push bevel and the inner wall of the mounting cavity; the inner wall of the mounting cavity 4 defines a limit groove 14, and an outer side of the functioning sleeve 13 is arranged with a limit bump 15 disposed in the limit groove 14, which improves the fixing effect of the pressing member; an inner edge of a lower end of the functioning sleeve 13 has a rounded transition; a side part of the cover body 2 is arranged with multiple sliding ports 16 connected to the mounting cavity 4, and the locking member 6 is slidably connected to a corresponding sliding port 16; an inner end of the locking member 6 is arranged with a first reset spring 17 connected to a side wall of the mounting cavity 4 and transversally arranged; as shown in FIGS. 5 and 6, a second reset spring 18 is arranged vertically at a bottom of the mounting cavity 4, and the pressure relief member 9 includes a movable column 19 matched with a lower opening of the mounting cavity 4 in a spaced-apart manner, and a top of the movable column 19 is arranged with a connection member 20 interlocked with the movable column 19; the second reset spring 18 encloses the movable post 19 and an upper end of the second reset spring 18 is connected to the connection member 20; a bottom surface of the cover body 2 defines a circular groove 21 matched with the lower opening of the mounting cavity 4, and the seal block 11 is adapted to the circular groove 21; the circular groove 21 has a beveled side, which further makes the contact surface higher; an annular foam cavity 22 is arranged in the cover body 2 around the mounting cavity 4, which may be filled with foam to improve the heat preservation ability; a lower edge of an outer end of the locking member 6 has a rounded transition, which may be naturally squeezed inward when contacting the edge of the box body; the cover body includes a bottom plate, an intermediate piece, and a top cover, which are sequentially fastened from the bottom to the top to define a mounting cavity, and the annular foam cavity is defined between the top cover and the intermediate piece; a seal ring 3 is arranged on a lower edge of the cover body 2, and an annular strip 23 is arranged on an upper part of an inner cavity of the box body 1 matched with the seal ring 3, and sealing is realized by the extrusion of the seal ring and the annular strip of the box body when the lid body is loaded.

Working principle: during unlocking, the pressing member is pressed, such that the pressing member moves down and makes the locking member move inward by squeezing the internal push bevel, and the end of the locking member leaves the clamping groove of the box body, thereby realizing the unlocking such that the cover body can be pulled out quickly; after the cover body is pulled out, the hand leaves the pressing member, and the pressing member is driven reset again through the elasticity of the locking member and the internal push bevel; during the unlocking process, the pressing member further squeezes the pressure relief member to move down, and the pressure relief member moves down to drive the seal block to move away from the lower opening of the mounting cavity, such that the pressure of the box body can enter the mounting cavity from the lower opening of the mounting cavity, thereby realizing the decompression of the box body, preventing the occurrence of the cover body popping, and ensuring safe use; when the cover body is closed, the locking member of the outer end of the box body is squeezed by the edge of the box body and moved inward, and the locking member is moved outward by the elastic force and embedded in the clamping groove for quick locking when reaching the clamping groove.

The above embodiments only express the mode of implementation of the present disclosure, the description is more specific and detailed, but it should not be construed as a limitation on the scope of the present disclosure. In the embodiments, terms of "upper", "lower", "left", "right", "front", "back' etc. only represent relative positions and does not represent absolute positions. It should be noted that, for those skilled in the art, several deformations and improvements can be made without departing from the conception of the present disclosure, which all belong to the scope of the present disclosure. Therefore, the scope of the present disclosure shall be subject to the appended claims.

What is claimed is:

1. A portable insulated lunch box, comprising: a box body (1) and a cover body (2) adapted to the box body (1); the cover body (2) defines a mounting cavity (4) passing vertically through the cover body (2), an upper opening of the mounting cavity (4) is arranged with a pressing member (5), and a plurality of locking members (6), that are transversely, elastically, and movably connected, are arranged in the mounting cavity (4); an outer end of each locking member (6) passes through a cavity wall of the mounting cavity (4), and an inner end of each locking member (6) is arranged with an internal push bevel (7) matched with a lower edge of the pressing member (5); an inner side wall of the box body (1) is arranged with a plurality of clamping grooves (8) each matched with the outer end of a corresponding locking member (6); a lower part of the mounting cavity (4) is arranged with a pressure relief member (9) that is vertically, elastically, and movably connected, and an exhaust gap (10) is defined between the pressure relief member (9) and a lower opening of the mounting cavity (4); a top of the pressure relief member (9) is attached to the pressing member (5), and a bottom of the pressure relief member (9) is arranged with a seal block (11) disposed on an outside of the cover body (2) and covering the lower opening of the mounting cavity (4).

2. The portable insulated lunch box according to claim 1, wherein the pressing member (5) comprises a pressing plate (12), and a bottom of the pressing plate (12) defines a functioning sleeve (13); a side wall of the functioning sleeve (13) is disposed between the internal push bevel (7) and an inner wall of the mounting cavity (4).

3. The portable insulated lunch box according to claim 2, wherein the inner wall of the mounting cavity (4) defines a limit groove (14), and an outer side of the functioning sleeve (13) is arranged with a limit bump (15) disposed in the limit groove (14).

4. The portable insulated lunch box according to claim 2, wherein an inner edge of a lower end of the functioning sleeve (13) has a rounded transition.

5. The portable insulated lunch box according to claim 1, wherein a side part of the cover body (2) is arranged with a plurality of sliding ports (16) connected to the mounting cavity (4), and each locking member (6) is slidably connected to a corresponding sliding port (16); an inner end of the locking member (6) is arranged with a first reset spring (17) connected to a side wall of the mounting cavity (4) and transversally arranged.

6. The portable insulated lunch box according to claim 1, wherein a second reset spring (18) is arranged vertically at a bottom of the mounting cavity (4), and the pressure relief member (9) comprises a movable column (19) matched with a lower opening of the mounting cavity (4) in a spaced-apart manner, and a top of the movable column (19) is arranged with a connection member (20) interlocked with the movable column (19); the second reset spring (18) encloses the movable post (19) and an upper end of the second reset spring (18) is connected to the connection member (20).

7. The portable insulated lunch box according to claim 1, wherein a bottom surface of the cover body (2) defines a circular groove (21) matched with the lower opening of the mounting cavity (4), and the seal block (11) is adapted to the circular groove (21); the circular groove (21) has a beveled side.

8. The portable insulated lunch box according to claim 1, wherein a seal ring (3) is arranged on a lower edge of the cover body (2), and an annular strip (23) is arranged on an upper part of an inner cavity of the box body (1) matched with the seal ring (3).

9. The portable insulated lunch box according to claim 1, wherein an annular foam cavity (22) is arranged in the cover body (2) around the mounting cavity (4).

10. The portable insulated lunch box according to claim 1, wherein a lower edge of an outer end of each locking member (6) has a rounded transition.

* * * * *